United States Patent [19]

Lindsey

[11] Patent Number: 4,460,107

[45] Date of Patent: Jul. 17, 1984

[54] PLURAL MODE MULTI-COLUMN DISPENSING MACHINE

[75] Inventor: James C. Lindsey, Chattanooga, Tenn.

[73] Assignee: Cavalier Corporation, Chattanooga, Tenn.

[21] Appl. No.: 347,038

[22] Filed: Feb. 8, 1982

[51] Int. Cl.[3] ..... G07F 11/08

[52] U.S. Cl. ..... 221/67; 221/115; 221/241

[58] Field of Search ..... 221/67, 115, 116, 241, 221/242

[56] References Cited

U.S. PATENT DOCUMENTS

| | | | |
|---|---|---|---|
| 2,762,524 | 9/1956 | Johnson . | |
| 2,836,326 | 5/1958 | Childers . | |
| 2,877,924 | 3/1959 | Childers et al. . | |
| 3,107,812 | 10/1963 | Payne et al. . | |
| 3,107,813 | 10/1963 | Payne et al. . | |
| 3,146,907 | 9/1964 | Bookout . | |
| 3,151,770 | 10/1964 | Payne . | |
| 3,151,772 | 10/1964 | Payne . | |
| 3,158,247 | 11/1964 | Gale . | |
| 3,158,290 | 11/1964 | Hafley et al. . | |
| 3,209,942 | 10/1965 | Gasparini et al. . | |
| 3,224,631 | 12/1965 | Payne . | |
| 3,251,505 | 5/1966 | Johnson et al. . | |
| 3,300,084 | 1/1967 | Payne . | |
| 3,341,069 | 9/1967 | Newberry . | |
| 3,362,579 | 1/1968 | Newberry . | |
| 3,454,192 | 7/1969 | Johnson | 221/67 |
| 3,463,355 | 8/1969 | Ural . | |
| 3,722,744 | 3/1973 | Payne . | |
| 3,796,345 | 3/1974 | Fessler . | |
| 3,799,393 | 3/1974 | Baxendale | 221/67 |
| 3,810,560 | 5/1974 | Stegeman . | |
| 3,904,076 | 9/1975 | Payne . | |
| 4,019,650 | 4/1977 | Oden . | |
| 4,036,400 | 7/1977 | Oden | 221/67 |
| 4,298,138 | 11/1981 | Oden . | |

*Primary Examiner*—F. J. Bartuska

*Attorney, Agent, or Firm*—Kerkam, Stowell, Kondracki & Clarke

[57] ABSTRACT

A vending or dispensing machine is disposable in modes for triple depth dispensing, double depth dispensing, and single depth dispensing. Upper and lower gating members or rockers are used to selectively release cylindrical articles such as cans or bottles from a storage compartment containing staggered tandem columns into a consumer accessible dispensing zone. The upper and lower rockers are moved by a drive plate which causes reciprocation of the rockers by way of drive pins. Removable retaining members are used for preventing premature release of center column cans and also provide an anti-theft feature. A removable gating piece is used to prevent the premature release of a rear column can. A freely swinging anti-theft bar has a stepped portion which keeps a can from being axially slid in the escrow zone disposed between the storage compartment and the dispensing zone, thereby preventing the unauthorized removal of the can. A timer cam which is programmed by adjustable cover plates is used for changing the mode for different depth operations.

25 Claims, 12 Drawing Figures

23H
23
23H 32
24UB
26UB
24LB
30
20U
31S
20L
23
22C
22R
24UF
28U
26UF
24LF
28L
54
54H
26UH
26LF
28UC
26UP
57R
26LH
26LP
56
57L
28LC
59L
58
28UD
59R
60A
60S
60D
28LD
DRIVE SHAFT

FRONT OR 1st COLUMN ZONE
2nd COLUMN ZONE
3rd COLUMN ZONE
A COLUMN ZONE
B COLUMN ZONE
37B
37B
37H
36U
36M
36L
38
37
39S
39F

PLURAL MODE MULTI-COLUMN DISPENSING MACHINE

BACKGROUND OF THE INVENTION

This invention relates to a dispensing apparatus. More particularly, this invention relates to a vending machine for vending cans, bottles, or similar generally cylindrical articles.

The prior art includes numerous devices which are designed to dispense cans or bottles arranged in tandem staggered columns. Each staggered column includes a right subcolumn or series of cans adjacent a right wall and a left subcolumn or series of cans adjacent a left wall. In order to dispense cans alternately from the columns various constructions have been used. Often such devices employ a gating member associated to support the right subcolumn of cans and a separate gating member to support the left subcolumn of cans. Other such devices have used gating members wherein each gating member may move from one subcolumn to another to alternately release cans or bottles from the right and left subcolumns. Use of either of these two types of gating members or any of numerous other possible constructions for tandem staggered columns has further required numerous design features to prevent the gating member or members from simultaneously dropping two or more cylindrical articles such as cans into a dispensing zone usually disposed below such gating members. That is, the mechanism must be designed so that, for example, the dispensing of the right subcolumn front can may be made while the gating member or members continues to secure the right subcolumn back can.

The following patents show various devices of this type:

| Patent No. | Inventor(s) | Issue Date |
|---|---|---|
| 2,836,326 | Childers | May 27, 1958 |
| 3,209,942 | Gasparini et al | Oct. 5, 1965 |
| 3,224,631 | Payne | Dec. 21, 1965 |
| 3,251,505 | Johnson et al | May 17, 1966 |
| 3,300,084 | Payne | Jan. 24, 1967 |
| 3,362,579 | Newberry | Jan. 9, 1968 |
| 3,454,192 | Johnson | July 8, 1969 |
| 3,463,355 | Ural | Aug. 26, 1969 |
| 3,722,744 | Payne | Mar. 27, 1973 |
| 3,796,345 | Fessler | Mar. 12, 1974 |
| 3,799,393 | Baxendale | Mar. 26, 1974 |
| 3,810,560 | Stegeman | May 14, 1974 |
| 3,904,076 | Payne | Sept. 9, 1975 |
| 4,019,650 | Oden | April 26, 1977 |
| 4,298,138 | Oden | Nov. 3, 1981 |

The Childers patent shows a dispensing machine having rods 184 and plates 185 to dispense alternately from two tandem staggered columns.

The Gasparini et al patent discloses a vending mechanism having movable support bars 21 and 22 which are moved by a movable reciprocating carriage (see especially 45 and 46 of FIG. 7).

The Payne U.S. Pat. Nos. 3,224,631, 3,300,084 and 3,904,076 show dispensing machines having upper support rods and a lower support which only supports cans from the front column of two tandem columns. Further, provision is made for dispensing from a single column.

The E. C. Johnson et al U.S. Pat. No. 3,251,505 discloses a dispensing mechanism with 2 motor-driven rods and having a camming drive arrangement.

Newberry uses a 2 part cradle to dispense from 2 tandem staggered columns of cans or 1 staggered column of bottles.

The P. A. Johnson U.S. Pat. No. 3,454,192 discloses a dispensing apparatus for dispensing cans from three tandem staggered stacks. The sequence of dispensing is front-middle-rear on one sidewall then front-middle-rear from the cans on the other sidewall. Two support members 9L and 9R cooperate with a stepped sidewall having steps 11R, 13R, and 15R (see especially FIG. 2) to selectively release the front, middle, or rear can.

The Ural patent discloses a vending machine adaptable to vend either cans or bottles. A masking plate 86 is used to cover a notch in timing cam 80 (FIG. 8) in order to change the operation from cans to bottles. Additionally, ribs 126 are used to accomplish the bottle/can change-over. Offset wall portion 132 is used to release one can from bail 16, while another can is held.

The Payne U.S. Pat. No. 3,722,744 patent shows a split vend gate mechanism for dispensing cans from alternate tandem columns by 90° rotation or bottles from a single column by 180° rotation.

The Fessler patent vending mechanism dispenses cans from tandem staggered columns by use of an anti-theft bar 19 and a storage shelf 14 which supports cans from only one column.

The Baxendale patent shows a vending mechanism suitable for single depth vending of bottles (FIGS. 8–11) or double depth vending of cans (FIGS. 12–15). An escrowing assembly includes parts 188 and 190 with width adjustment parts 210′ and 212′ (see especially FIG. 7) to support a can in one column when a can in another column has been released. A programmable cam 110 (FIG. 5) is used.

The Stegeman patent discloses the use of a two-part cradle support (compare especially FIG. 2 and FIG. 3) which may be used to dispense from two tandem stacks of cans or one stack of bottles.

The Oden U.S. Pat. No. 4,019,650 patent discloses a vending mechanism for front and back staggered stacks. An upper and lower bale 22 and 24 are fixed together to rotate as a unit. A stepped portion 26 on the lower bail supports a back column can after the dispensing of a front column can.

The Oden U.S. Pat. No. 4,298,138 patent discloses a vending mechanism having a cradle with steps in order to release a front/back can every one half revolution or one bottle every revolution. The operation of the step cradle is shown in FIGS. 5–11.

The prior art is replete with numerous other constructions for dispensing cans and/or bottles. Among these other patents:

| Patents | Inventor(s) | Issue Date |
|---|---|---|
| 2,762,524 | Johnson | Sept. 11, 1956 |
| 2,877,924 | Childers et al | March 17, 1959 |
| 3,107,812 | Payne et al | Oct. 22, 1963 |
| 3,107,813 | Payne et al | Oct. 22, 1963 |
| 3,146,907 | Bookout | Sept. 1, 1964 |
| 3,151,770 | Payne | Oct. 6, 1964 |
| 3,151,772 | Payne | Oct. 6, 1964 |
| 3,158,247 | Gale | Nov. 24, 1964 |
| 3,158,290 | Hafley et al | Nov. 24, 1964 |
| 3,341,069 | Newberry | Sept. 12, 1967 |

Although such prior art has been generally useful for the purpose intended, these prior art devices have been generally subject to one or more of a number of disadvantages. In particular, many of these constructions have required complex mechanisms which are subject to jamming and/or malfunction. Some of the prior art mechanisms for dispensing from tandem staggered columns have insufficient theft protection. Often, these mechanism are inadequately adaptable to various sizes of cans, bottles or similar cylindrical articles. Those prior art devices which do provide for different sized cans and/bottles may not have the desirable depth (i.e., accommodating several tandem columns). Numerous of these prior art constructions require a gating member, commonly called a rocker, which will lift a column of cans in order to separate a lowermost can, thereby placing a relatively heavy load on the driving motor for the gating member.

OBJECTS

Accordingly, it is a general object of the present invention to provide a new and improved dispensing apparatus.

Another object of the present invention is to provide a dispensing apparatus which is adaptable to function in a number of different modes having different multiple column arrangements.

Another object of the present invention is to provide a dispensing apparatus having various features which eliminate or minimize theft.

Yet another object of the present invention is to provide a dispensing apparatus having a gating arrangement wherein the lifting of a column of cans is unnecessary.

A still further object of the present invention is to provide a dispensing apparatus which is relatively immune to jamming and similar malfunctions.

SUMMARY OF THE INVENTION

These and other objects of the present invention which will become apparent as the description proceeds are realized by a dispensing apparatus including at least one dispensing assembly comprising a storage compartment defined by front, back, right side and left side walls and adapted to store a plurality of cylindrical articles in column arrangements, a motor-driven upper gating member for normally supporting cylindrical articles stored in the compartment and controllable for releasing cylindrical articles for downward movement, a motor-driven lower gating member for normally supporting cylindrical articles which have been released by the upper gating member and adapted to selectively release cylindrical articles for downward movement, the upper and lower gating members each extending longitudinally front to back and reciprocately moving between right and left, and a dispensing zone under the lower gating member for receiving cylindrical articles released by the lower gating member. The dispensing assembly is disposable in a single depth, double depth and triple depth dispensing modes for dispensing one cylindrical article at a time. The dispensing assembly further includes first and second drive pins connected respectively to the upper and lower gating members for causing reciprocation thereof, and a motor operably connected to drive the upper and lower gating members by respectively causing the first and second drive pins to move. The dispensing assembly further includes first and second removable retaining members, each attachable at one of the side walls in a retaining position, to prevent cylindrical articles in one column from dropping into the dispensing zone when a corresponding cylindrical article from another column drops into the dispensing zone.

BRIEF DESCRIPTION OF THE DRAWINGS

The above and other objects of the present invention and the various features of the present invention will be more readily understood from the following detailed description of the invention when taken in conjunction with the FIGURES, in which like characters represent like parts throughout the several views.

DETAILED DESCRIPTION OF THE PREFERRED EMBODIMENTS

Figure 1:
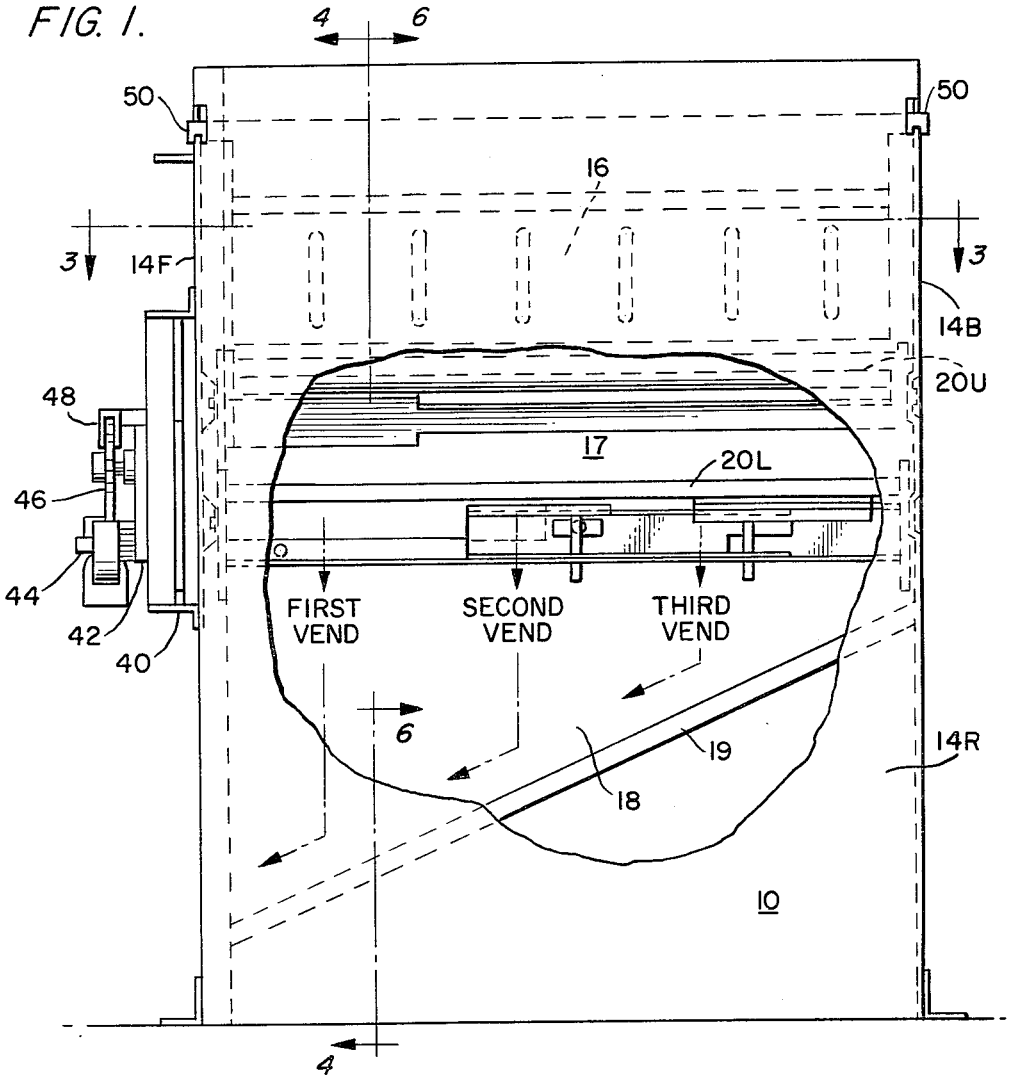
FIG. 1 is a side view with parts broken away of the present invention.
Figure 3:
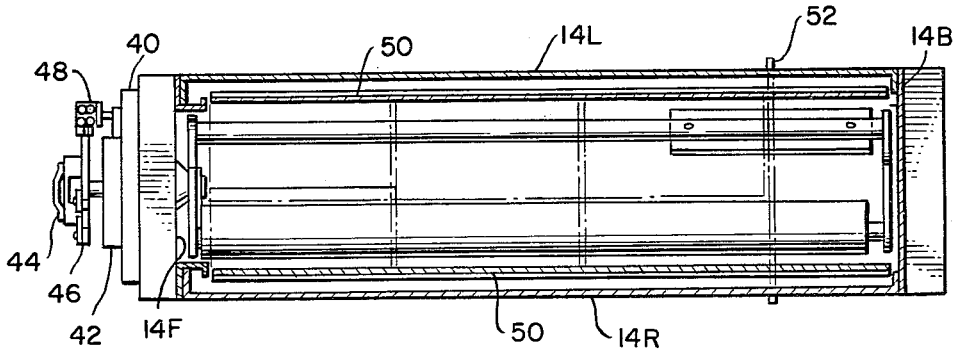
FIG. 3 is a top view in cross section taken along lines 3—3 of FIG. 1.
Figure 2:
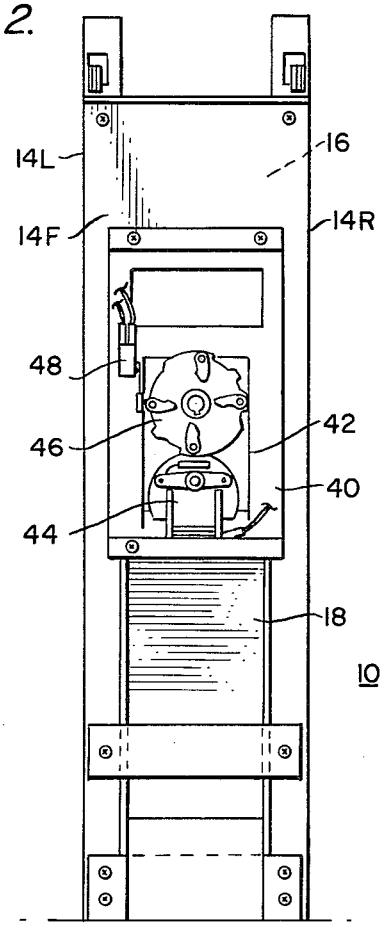
FIG. 2 shows a front view of the dispensing assembly of the present invention.

Turning now to FIGS. 1, 2 and 3 a brief overall description of the present invention will be presented. FIG. 1 shows a right side view of the dispensing assembly 10 according to the present invention with part of the right side wall 14R broken away. FIG. 2 shows a front view of the dispensing assembly 10 according to the present invention, whereas FIG. 3 shows a top view in cross section along lines 3—3 of FIG. 1 of the dispensing assembly 10 according to the present invention.

The dispensing assembly 10 according to the present invention includes a housing 12 having front, back, right and left side walls 14F, 14B, 14R and 14L respectively. Disposed in the upper part of housing 12 is a storage compartment 16 defined by the walls 14F, 14B, 14R and 14L and adapted to store a plurality of cylindrical articles such as bottles and/or cans. The storage compartment 16 is separated from a dispensing zone 18 by an escrow zone 17 having upper and lower gating members 20U and 20L respectively. Such gating members are commonly called rockers in the dispensing machine industry. The dispensing zone 18 may include a chute 19. Regardless, the dispensing zone 18 is arranged such that a soft drink can or bottle or similar product which drops into the dispensing zone will be available to the consumer without insertion of any additional money.

Mounted to the outside of front wall 14F, or possibly even forming a part of front wall 14F, is a drive assembly housing 40. Attached to the outside of drive assembly housing 40 is a gear box 42, electromagnetic motor 44, and motor-driven cam 46, and cam follower controlled switching unit 48. The motor 44 drives the cam 46 by way of gear box 42, which gear box is of conventional construction. The gear box 42 also transmits power to various mechanisms inside of drive assembly housing 40, the details of which will be discussed below, which then results in movement of upper and lower gating members 20U and 20L in a pattern to cause the dispensing of cylindrical articles from the storage compartment 16 into the dispensing zone 18 one at a time. The switching unit 48, which includes two cam follower controlled switches, controls the energization of vend motor 44 in the manner prescribed by U.S. Pat. No. 4,220,235, issued to Lindsey et al on Sept. 2, 1980, assigned to the assignee of the present invention, and hereby incorporated by reference. The dispensing assembly 10 according to the present invention may dispense cylindrical articles from three staggered tandem axially-spaced columns for a first vend, second vend and third vend as shown in FIG. 1. Alternately, the dispensing assembly 10 may be easily adjusted for dispensing cylindrical articles from two axially spaced staggered columns. The dispensing assembly 10 may also be configured to dispense from one staggered column of cylindrical articles. The adjustments necessary for changing the dispensing assembly 10 between three column, two column and one column operation will be discussed below.

The storage compartment 16, which is defined by the walls 14F, 14B, 14R and 14L, may be adapted to accomodate various size cylindrical articles by use of a variable number and/or variable thickness side spacers such as 50 and a back spacer 52 (back spacer 52 is shown only in FIG. 2). Side spacers 50 may hang from a part of front and back walls 14F and 14B respectively. The back spacer 52 may seat on each side wall 14L and 14R on opposite notches in a series of notches in the side walls 14L and 14R, which notches are not shown for simplicity sake.

Figures 10, 11, 11A:
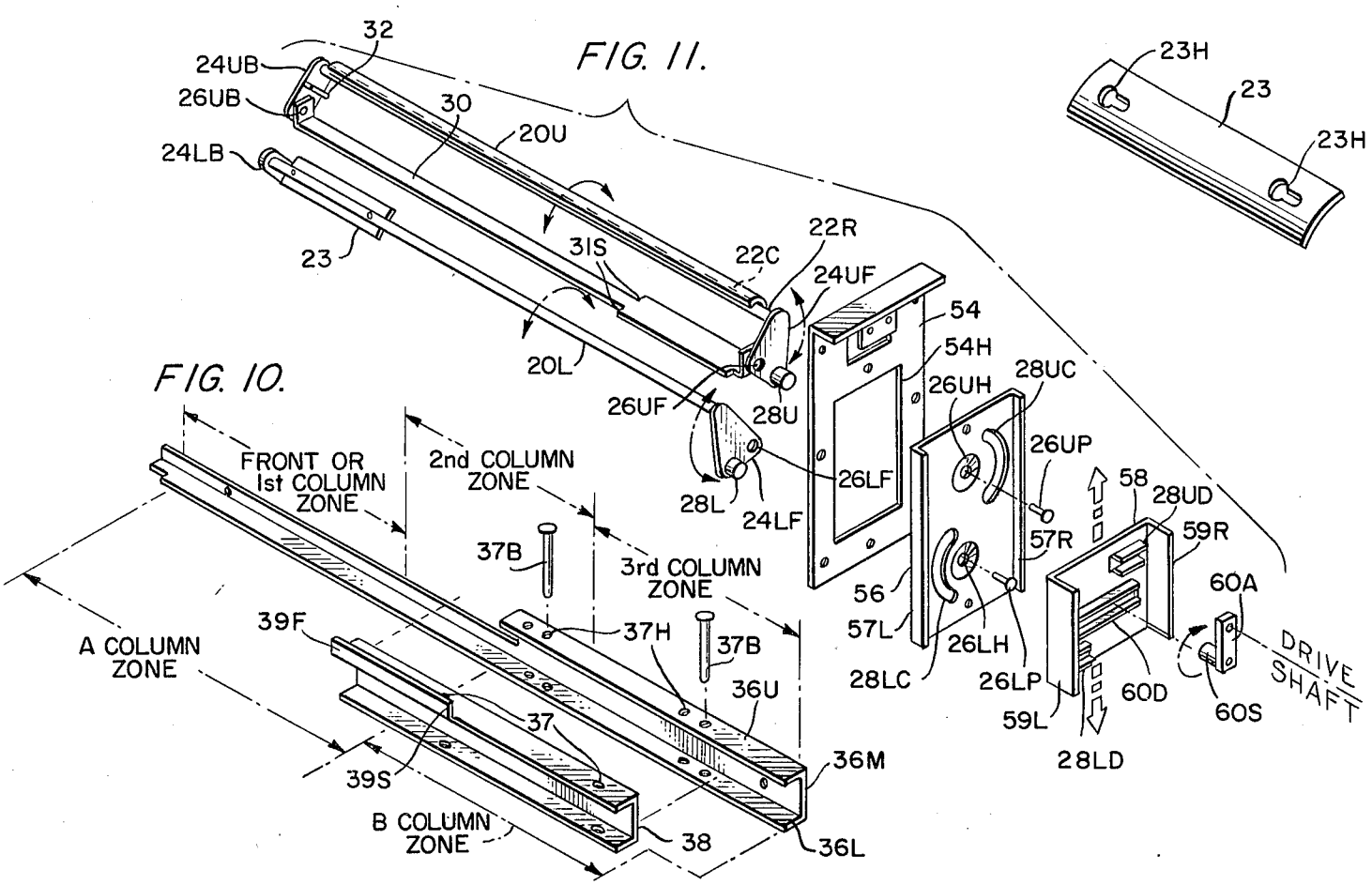
FIG. 10 shows the removable retaining member and associated ledge structures according to the present invention.
FIG. 11 shows in exploded form a perspective of the mechanical driving arrangement according to the present invention.
FIG. 11A shows a perspective of a removable gating piece according to the present invention.

Continuing to view FIGS. 1, 2 and 3, but also considering the perspective exploded view of FIG. 10 taken from the right rear corner, the ledge structure just above dispensing zone 18 will presently be discussed. A ledge member 36M is mounted on each of the right and left side walls 14L and 14R. Ledge member 36M includes an upper ledge 36U which extends only partially along the length of the member and a lower ledge 36L which extends substantially the full length of member 36M. Each ledge member 36M may be bolted or otherwise affixed to the corresponding side wall 14L or 14R. A removable retaining member such as channel extension 38 is attachable to member 36M by partially nesting in between the upper and lower ledges 36U and 36L. Pins or studs 37B simply drop into corresponding holes 37H on both member 36M and retaining member 38 in order to secure the two members together. The effect of attaching member 38 to ledge member 36M is to effectively lengthen the upper ledge 36U in order to accommodate various length or size cylindrical articles. Additionally, removable retaining member 38 includes a flange 39F, the back end of which serves as an anti-theft stop 39S.

Figure 9:
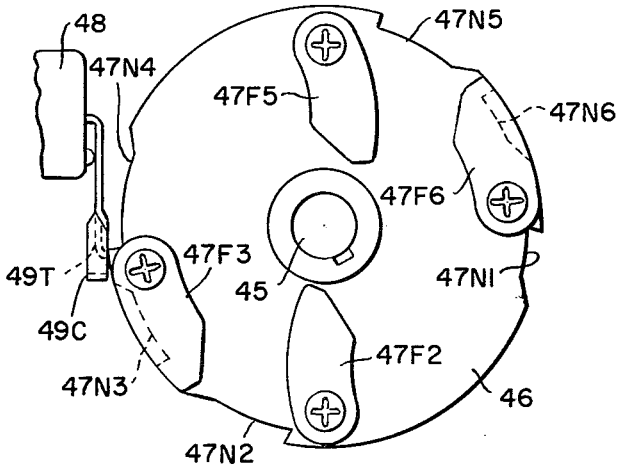
FIG. 9 shows a front view of the timing cam according to the present invention.

Turning now to FIG. 9, but continuing to consider FIGS. 1-3, the timing cam 46 will presently be discussed. The timing cam 46 has cam followers 49T and 49C associated therewith and respectively corresponding to the timer switch and credit release switch of the above identified and incorporated by reference Lindsey et al U.S. Pat. No. 4,220,235. Each cam follower 49T and 49C controls a separate switch of the switching unit 48 in the manner discussed in the incorporated patent. The cam 46 rotates with its shaft 45 and includes six notches 47N1, 47N2, 47N3, 47N4, 47N5 and 47N6 which change the state of the switches corresponding to cam followers 49C and 49T. Associated with notches 47N2, 47N3, 47N5 and 47N6 are respective corresponding masking plates 47F2, 47F3, 47F5 and 47F6. As shown in FIG. 9, masking plates 47F3 and 47F6 are masking the respective notches 47N3 and 47N6 such that cam followers 49T and 49C will not sense the presence of these notches. Masking plates 47F2 and 47F5 could likewise be used to mask their corresponding respective notches. By simply turning the screw which holds a particular masking plate to the cam 46, and tightening the screw when the masking plate covers a notch, the cam 46 may be re-programmed depending upon whether the dispensing assembly 10 is placed in its single depth mode, double depth or triple depth.

Turning now to FIGS. 11 and 11A, but continuing to consider FIGS. 1-3, the construction of the upper and lower gating members 20U and 20L and their associated driving mechanisms will presently be discussed. FIG. 11 shows an exploded perspective from the front left corner of the upper and lower gating members 20U and 20L and assocated parts, whereas FIG. 11A shows a simple perspective of a removable gating piece 23 which fits on lower gating member 20L.

Upper gating member or rocker 20U includes a concave down cylindrically curved part 22C which is welded or otherwise attached to rod 22R, whereas lower gating member or rocker 20L is a simple rod which may have a removable gating piece 23 attached thereto. Removable gating piece 23 includes keyhole-shaped holes 23H which allow it to be easily attached and removed from bolts screwed into or otherwise attached to gating member 20L. Upper and lower front end plates 24UF and 24LF are welded respectively to the front ends of upper and lower gating members 20U and 20L. Each of the front end plates 24UF and 24LF is generally triangular in shape with rounded points as shown and includes corresponding respective drive pins 28U and 28L and pivot points 26UF and 26LF. The pivot points 26UF and 26LF are vertically in line as are pivot points 26UB and 26LB at the back side. The upper gating member 20U, upper drive pin 28U, and the front-to-back upper axis defined by the pivot point 26UF and a back pivot point 26UB are axially out of line. The lower gating member 20L, lower drive pin 28L, and the front-to-back axis defined by the pivot point 26LF and a back pivot point 26LB (blocked from view by gating piece 23) are axially out of time, meaning that each is displaced relative to the other in the plane perpendicular to the axis. Generally oval shaped back end plates 24UB and 24LB are disposed at the back ends of upper and lower gating members 20U and 20L. End plate 24UB, which is generally planar as are the three other end plates, includes a flange 32 which extends normal to its plane and serves to keep an anti-theft bar 30 which is freely swinging about pivot points 26UB and 26UF from swinging too high.

Plate 54, which may alternately be part of the front wall 14F itself, includes a hole 54H which is covered by plate or mounting portion 56. Although shown as being fixed to plate 54, mounting portion 56 could alternately be part of plate 54 itself or part of the front wall itself. Mounting portion 56 includes right and left flanges 57R and 57L which serve to constrain a movable drive plate 58 having right and left flanges 59R and 59L. Drive arm 60A is attached to one end to a drive shaft (not shown) extending from the gear box 42 (FIGS. 1, 2 and 3 only) and at the other end to a circularly moving shaft 60S which rides in motor-driven slot 60D. As the drive shaft causes shaft 60S to move in a circle, shaft 60S and associated slot 60D cooperate to cause drive plate 58 to reciprocate up and down within the confines of right and left flanges 57R and 57L of the cam plate 56. Upper and lower drive pins 28U and 28L extend through corresponding respective upper and lower arcuate slots 28UC and 28LC and corresponding respective upper and lower drive slots 28UD and 28LD. Reciprocation of drive plate 58 thereby causes the drive pins 28U and 28L to move up and down in the slots 28UC and 28LC. This in turn causes the upper and lower gating members 20U and 20L to pivot about a front-to-back axis including respective pivot points 26UF and 26LF which are fixed in holes 26UH and 26LH by corresponding pivot pins 26UP and 26LP. Each axis includes a pivot point at the corresponding rear plate 24UB or 24LB, although only rear pivot point 26UB is visible in FIG. 11 because of the presence of removable gating piece 23. As drive plate 58 reciprocates up and down and moves drive pins 28U and 28L in the associated slots 28UC and 28LC, the upper and lower gating members 20U and 20L reciprocate in an arcuate path between right and left.

OPERATION

Triple Depth Mode

Figure 4:
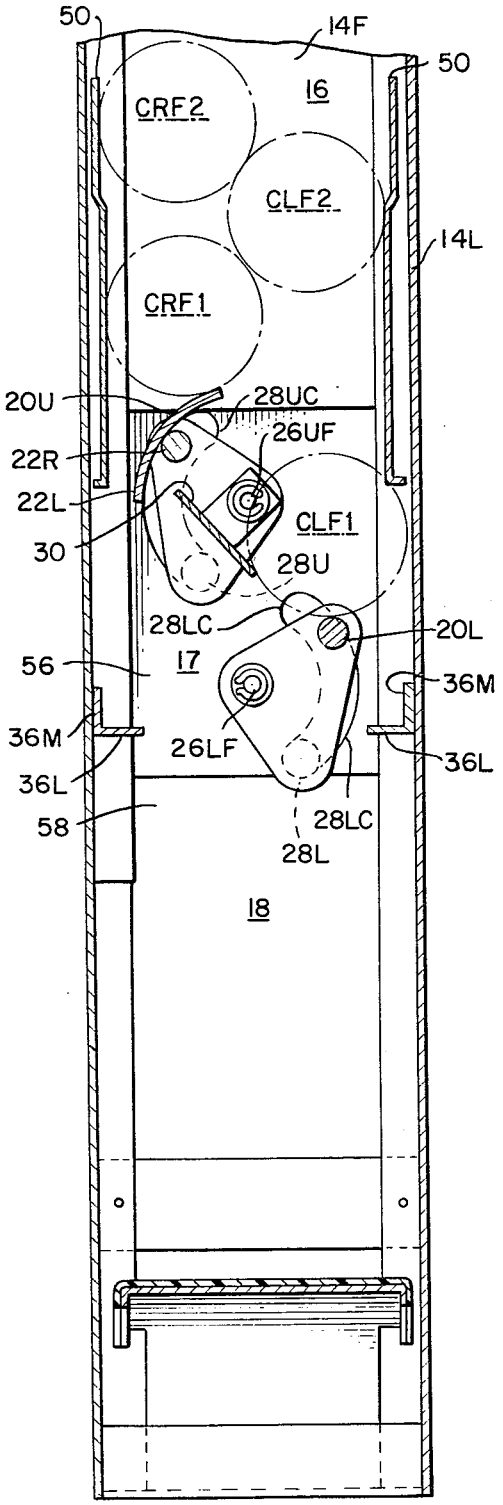
FIG. 4 is a cross sectional view taken along lines 4—4 of FIG. 1.
Figure 5:
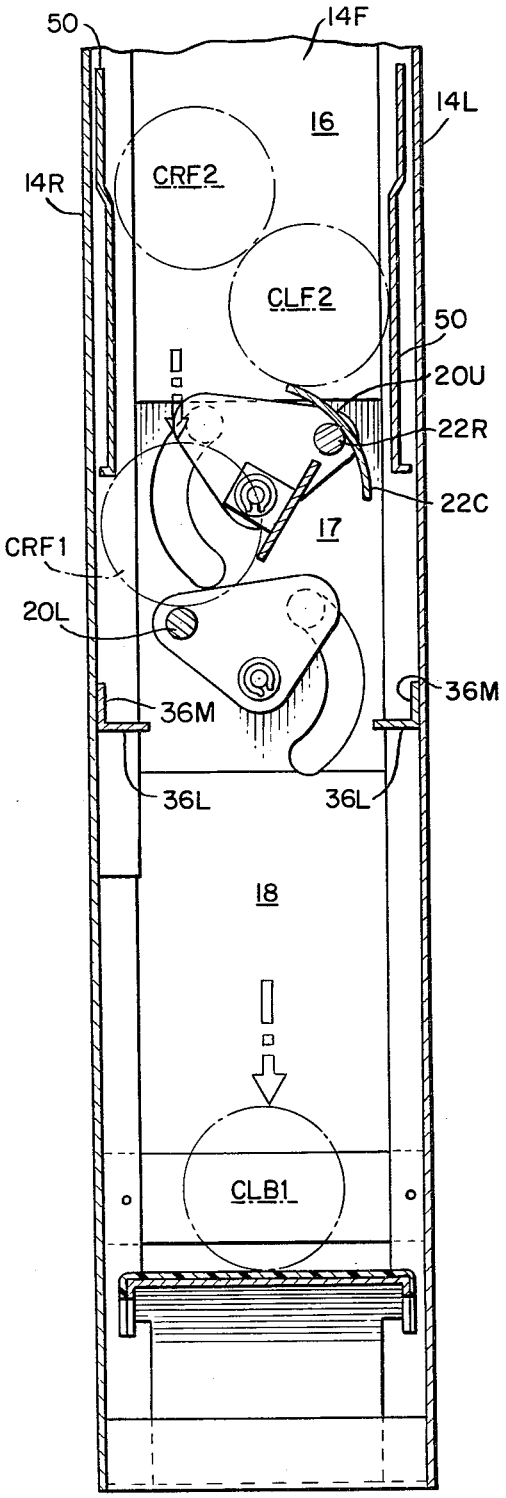
FIG. 5 shows the same view as FIG. 4 with parts of the present invention moved from the positions they held in FIG. 4.
Figure 8:
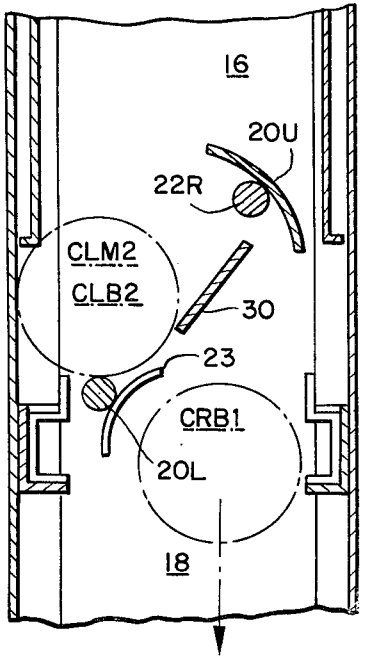
FIGS. 6, 7 and 8 show cross sectional view taken along lines 6—6 of FIG. 1 and illustrate a sequence of operations of the vending mechanisms of the present invention.
Figure 7:
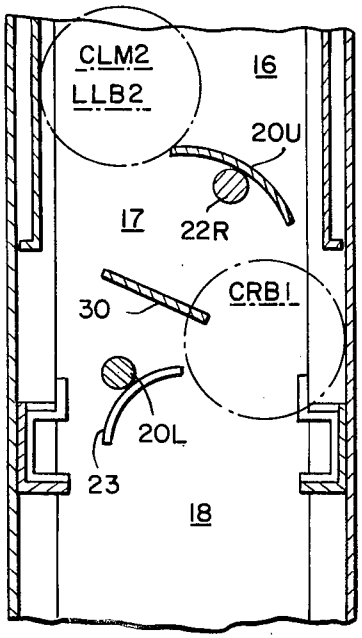
Figure 6:
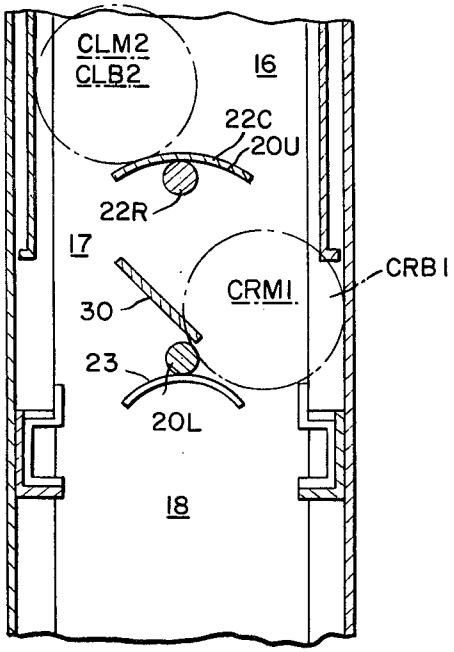

Turning now to FIGS. 4–8, but continuing to consider the above-discussed figures, especially FIGS. 10, 11 and 11A, the operation of the present invention when disposed in a three column or triple depth mode will presently be discussed. FIGS. 4 and 5 show views taken along lines 4—4 of FIG. 1 with the upper and lower gating members 20U and 20L in different positions, whereas FIGS. 6–8 show the view taken along lines 6—6 of FIG. 1 also illustrating movement of the upper and lower gating members 20U and 20L.

Considering first especially FIGS. 4 and 5, the dispensing of a front column can will be discussed. Initially, the front column cans are arranged in a storage compartment 16 in a staggered arrangement. Since FIGS. 4 and 5 are taken along lines 4—4 of FIG. 1, only the front column cans will be visible, although it is to be understood that middle and back column cans would be generally axially aligned with the front column cans disposed in the storage compartment 16. The front column includes right wall and left wall subcolumns as shown. Can CLF1 (left subcolumn of front column and lowest or first horizontal row) is disposed in an escrow zone 17 which lies generally between the storage compartment 16 and the dispensing zone 18. The escrow zone 17 is defined by the space in between the uppermost position of upper gating member 20U and the lowermost position of lower gating member 20L.

In the position shown in FIG. 4, the drive plate 58 (not shown in FIG. 4) would be in its lowermost position, thereby causing the upper and lower drive pins 28U and 28L to be at the lower ends of their respective corresponding slots 28UC and 28LC. Accordingly, the upper gating member 20U will be in its furthest right position, whereas the lower gating member 20L will be in its furthest left position. Of course, right and left are reversed in FIGS. 4 and 5 because the view is taken from the back. In the three column or triple depth mode, all of the notches in cam 46 (see especially FIG. 9) would be operational for providing camming action to the two cam followers 49T and 49C, thereby causing the drive plate 58 and, in turn, the upper and lower gating members 20U and 20L to stop in six different positions.

Upon the insertion of the requisite amount of money, the motor 44 will cause the drive plate to move upwardly until the next notch in the timing cam 46 is reached. At this point, lower rocker or gating member 20U will be sufficiently removed from left side wall 14L that the left front can CLF1 may drop from escrow zone 17 into dispensing zone 18 whereby a consumer may have access to it. Can CLF1 will pass by the lower ledge 36L disposed on the left sidewall 14L. Upon the next insertion of the requisite amount of money, the lower gating member 20L will move sufficiently further away from left wall 14L as to allow the dropping of a middle column can (not shown) in a manner discussed below. Although the upper gating member 20U has moved during the dispensing of the front and middle cans, the cylindrical curved concave downwardly surface of cylindrical part 22C has not yet released the right subcolumn cans including can CRF1. Quite importantly, the curve in cylindrical part 22C is such that this part does not lift up the cans when reciprocating from the position shown in FIG. 4 to the position shown in FIG. 5. Because the upper gating member 20U does not lift up the column of cans, the drive motor 44 need not be as powerful as otherwise might be the case.

Following the dispensing of the middle can, the next actuation as by insertion of money will cause lower gating member 20L to be moved further leftward to the position shown in FIG. 5. This causes the dispensing of the can CLB1 in a manner described below. Additionally, the cylindrical part 22C of upper gating member 20U to the position shown in FIG. 5 such that the first row right subcolumn cans including can CRF1 (and not visible in FIG. 6 cans CRM1 and CRB1) may drop into the escrow zone 17 as shown. The reciprocating drive plate 58 is in its uppermost position as are drive pins 28U and 28L in FIG. 5. Accordingly, upper gate member 20C is in its furthest left position whereas lower gate member 20L is in its furthest right position. The next activation of the motor 44 will cause the drive plate 58 to move downwardly such that the front column can CRF1 may drop between the lower gating member 20L on one side and the right side wall 14R and lower ledge 36L on the other side. Following this, the upper and lower gating members will be in the position shown in FIG. 6, which is a view taken along lines 6—6 of FIG. 1. As shown in FIG. 6, the channel extension removable retaining member 38 retains can CRM1 from dropping into the dispensing zone 18 when the front can CRF1 is released from the lower gating member 20L. Further, the back can CRB1 is prevented from being dispensed by the removable gating piece 23 and the upper ledge 36U. As shown in FIG. 10, the ledge members 36M have a front or first vend portion, a middle or second vend portion, and a back or third vend portion. When disposed in the three column or triple depth mode, lower gating member 20L will release the front can when the gating member 20L is sufficiently removed from the side wall. However, the middle can such as CRM1 shown in FIG. 6 will not be released until further movement of lower gating member 20L allows the can CRM1 to clear the upper ledge 36U and the channel extension removable retaining member 38 corresponding to the second vend zone indicated in FIG. 10. Can CRM1 will then be dispensed as shown in FIG. 7.

The back can CRB1 will not be dispensed at the same time as the middle can CRM1 because of the presence of removable gating piece 23 and the upper ledge 36U of ledge member 36M. The removable gating piece 23 is disposed solely within the back or third vend zone of the escrow zone 17.

It should further be emphasized that although the upper gating member has moved between FIGS. 6 and 7, the curve on its cylindrical part 22C is such that no upward movement of the cans CLM2 and CLB2 shown and the corresponding unshown can CLF2 has taken place. That is, the cylindrical part 22C does not lift up the column of cans during its arcuate movement between right and left.

Following the vending of the center or middle can CRM1 as shown in FIG. 7, the back can CRB1 will be vended as shown in FIG. 8 by the next actuation of the motor 44. Specifically, lower gating member 20L will reciprocate sufficiently leftward (corresponding to rotation or pivoting on the axis including pivot point 26LF) to allow the back can CRB1 to clear the gating piece 23 and upper ledge 36U. Additionally, before the movement of upper and lower gating members 20U and 20L has stopped in the positions shown in FIG. 8, shown cans CLM2 and CLB2 along with an unshown can CLF2 have been released by upper gating member 20U and drop from the storage compartment 16 into the escrow zone 17 as shown in FIG. 8. Further activation of the motor 44 will cause the sequential dispensing of cans CLF2, CLM2 and CLB2 in the same manner as discussed except that the upper gating member 20U will now move leftwardly and the lower gating member 20L will now move rightwardly.

With reference to FIGS. 4, 6, 7 and 8, the operation of anti-theft bar 30 will presently be discussed. When the front column can is disposed in the escrow zone 17 as shown in both FIGS. 4 and 8 the freely swinging anti-theft bar 30 is simply pushed aside by the front can CLF1 (FIG. 4) or CLF2 (for the position shown in FIG. 8 although CLF2 is not shown). However, once the front can has been dispensed, the anti-theft bar 30 will swing down by virtue of its narrower width at its back than its front. Accordingly, as best understood by considering FIG. 6 and FIG. 11 in conjunction, any attempt to illegally obtain the middle can CRM1 by causing it to slide forward into the front or first vend zone (FIG. 10) will be prevented by one of the stepped portions 31S (either right or left). For example, if an attempt is made to illegally obtain the middle can by simply tilting the machine forward, the middle can such as CRM1 will not slide into the front or first vend zone because it will hit one of the stops or stepped portions 31S before it has moved sufficiently forward to clear the retaining member 38. In a somewhat similar fashion, the anti-theft stop 39S formed by flange 39F of removable retaining member 38 will prevent the back can CRB1 (see especially FIG. 7) from being axially displaced or slid sufficiently forward to be vended by clearing the removable gating piece 23. That is, an attempt to displace forwardly a can in the third vend zone by sliding it forward will hit stop 39S as most clearly shown in FIG. 10. Stop 39S will prevent this back can from being slid sufficiently forward to illegally release it into the dispensing zone 18 when the machine is in the position of FIG. 7.

Double Depth Mode

To convert the machine from triple depth to double depth vending, the following steps should be taken:

(a) Cover cut-outs or notches 47N3 and 47N6 by properly adjusting the corresponding masking plates or cut-out covers. The timer cam 46 would then be programmed in the manner illustrated in FIG. 9. This would allow only four stops on the timer cam rather than 6.

(b) Remove the channel extensions 38 from their retaining position (i.e. flange 39F disposed at the upper front). If desired, the channel extension removable retaining members 38 may be disposed in an inoperative storage position with flange 39F at the back and facing down such that removable channel extensions 38 are telescoped between the ends of the corresponding upper ledge 36U of ledge member 36M with the pins 37P holding the channel extension 38 in place.

(c) Remove the gating piece 23 from the back of lower gating member 20L by simply loosening its two holding screws enough to utilize the key slots 23H to slide the piece 23 and clear the heads of the holding screws.

The machine would now be disposed to dispense one cylindrical article at a time from two tandem staggered columns of cylindrical articles. As will perhaps be best understood by considering FIGS. 10 and 11, the removal of channel extension 38 from its retaining position provides an A column vend zone which encompasses the first column zone and a portion of what was the second vend zone when disposed in the triple depth vending mode. Further, the removal of the gating piece 23 from lower gating member 20L prevents this gating piece from retarding the dispensing from a B column cylindrical article in a B column zone which may encompass the back portion of the second vend zone shown in FIG. 10 as well as the third zone of FIG. 10. Thus, the A and B column cylindrical articles may be significantly longer than the articles dispensed in the triple depth mode.

The operation in this mode will be quite similar in this mode will be quite similar to that in the triple depth mode. In particular, when the lower gating member 20L is sufficiently far from the wall, the front or A column cylindrical article will clear the lower ledge 36L and sidewall, thereby dropping into the dispensing zone 18. The next actuation of the motor 44 will cause the lower gating member 20L to move sufficiently further from the sidewall that the rear or B column cylindrical article will clear the upper ledge 36U and drop into the dispensing zone 18. Further, the dropping of cylindrical articles from the storage compartment into the escrow zone 17 by releasing from upper gating member 20U will be substantially the same as the operation described for the triple depth mode. However, because the items dispensed in the double depth mode may be of differing diameter as well as lengths from those articles dispensed in the triple depth mode, the removal or addition (or change in thickness) of side spacers 50 may be required in order to ensure that the cylindrical articles drop from the storage compartment 16 into the escrow zone 17 at the appropriate point in the travel in reciprocating upper gating member 20U. It may also be advisable to change the position of back spacer 52 (FIG. 3 only) to accommodate the dispensing of cylindrical articles in double depth. The cylindrical articles will in all likelihood be longer than those dispensed in the triple depth mode. Although now shown in the drawings, antitheft bar may include an additional pair of steps or stops similar to 31S, to prevent B column articles from being improperly dispensed by sliding from the B column zone into the A column zone.

Single Depth Mode

To convert the machine from double depth to single depth vending or dispensing, the notches 47N2, 47N3, 47N5 and 47N6 should all be covered by their associated covering or masking plates (see especially FIG. 9). The cam followers 39C and 39T will then sense only the notches 47N1 and 47N4. In this mode, the dispensing assembly 10 of the present invention may be used to dispense an extremely long bottle, can or similar cylindrical article. The operation is substantially similar to that discussed above. Of course, the upper and lower gating members 20U and 20L respectively will only stop at their extreme right and extreme left positions. Further, it may be necessary or advisable to change, add, or remove side spacers 50 and/or back spacer 52.

Although the present drawings show only a single dispensing assembly 10, a refrigerated cabinet or housing may enclose the dispensing assembly in a manner well known in the art. The front of the dispensing assembly 10 need not correspond with the front of such a cabinet, although it is preferable to situate the rockers or gating members 20U and 20L to extend from the front of the cabinet to the back. A number of dispensing assemblies 10 could be side-by-side within a single cabinet in this manner.

As used throughout this patent, the term "cylindrical article" shall include cans, bottle and the like. "Cylindrical" is simply used to mean generally tubular in shape and, of course, would include tapered bottles.

Although specifics of construction have been discussed herein, it is to be appreciated that the specifics of the preferred embodiments are for illustrative purposes only. Various modification and adaptations will be readily apparent to those of ordinary skill in the art. Accordingly, the scope of the present invention should be determined by reference to the appended claims.

What is claimed is:

1. A dispensing apparatus including at least one dispensing assembly comprising:

(a) a storage compartment defined by front, back, right side, and left side walls and adapted to store a plurality of cylindrical articles in column arrangement;

(b) first and second motor-driven gating members, each gating member for supporting cylindrical articles and for selectively releasing cylindrical articles for downward movement; and (c) a dispensing zone below said first and second gating members for receiving cylindrical articles released by said gating members; and wherein said dispensing assembly is operative to dispense one cylindrical articles at a time and is disposable in:

I. a triple depth mode for dispensing cylindrical articles sequentially from first, second and third tandem columns respectively disposed in first column, second column and third column zones, and II. a double depth mode for dispensing cylindrical articles sequentially from A and B tandem columns respectively disposed in an A column and a B column zone, said A column zone including at least part of said first column zone and at least part of said second column zone, and said B column zone including at least part of said second column zone and at least part of said third column zone, and wherein said first and second gating members are operable to reciprocate between right and left, and said first gating member is movable relative to said second gating member.

2. The dispensing apparatus of claim 1 wherein said first gating member is an upper gating member for normally blocking downward movement of cylindrical articles stored in said compartment and controllable for releasing cylindrical articles for downward movement, said upper gating member extending longitudinally front-to-back, and said second gating member is a lower gating member for normally blocking downward movement of cylindrical artilces which have been released by said upper gating member and for selectively releasing cylindrical articles for downward movement, said lower gating member extending longitudinally front-to-back.

3. The dispensing apparatus of claim 2 wherein said storage compartment is adapted to store columns of staggered cylindrical articles, each column having a first subcolumn and a second subcolumn, one subcolumn adjacent said right side wall and another subcolumn adjacent said left side wall.

4. The dispensing apparatus of claim 3 wherein said dispensing assembly further comprises a freely-swinging antitheft bar having stepped portions on right and left sides to prevent cylindrical articles from being improperly dispensed by being slid in an axial direction.

5. The dispensing apparatus of claim 3 wherein said dispensing assembly further comprises right and left removable retaining members attachable respectively at said right and left side walls in a retaining position, and each of said retaining members is disposed in its retaining position when said dispensing assembly is in its triple depth mode, each of said retaining members retaining second column cylindrical articles when a cylindrical article in said first column is released by said lower gating member.

6. The dispensing apparatus of claim 5 wherein said dispensing assembly further comprises right and left ledges projecting out from said respective right and left side walls, each of said ledges supporting cylindrical articles against premature dropping into said dispensing zone.

7. The dispensing apparatus of claim 6 wherein each of said removable retaining members includes an antitheft stop to prevent cylindrical articles from being improperly dispensed by being slid in an axial direction.

8. The dispensing apparatus of claim 3 wherein said dispensing assembly further includes a removable gating piece attachable to said lower gating member in said third column zone, said removable gating piece being attached to said lower gating member when said dispensing assembly is in said triple depth mode such that said removable gating piece prevents third column cylindrical articles from dispensing when second column cylindrical articles are released by said lower gating member.

9. The dispensing apparatus of claim 3 wherein said dispensing assembly further comprises:

upper and lower drive pins respectively connected to said upper and lower gating members for causing the pivoting of said upper and lower gating members repectively about a front-to-back upper axis and a front-to-back lower axis, and a motor operably connected to drive said upper gating member and said lower gating member by respectively driving said upper and lower drive pins.

10. The dispensing apparatus of claim 9 wherein said upper gating member, said upper drive pin, and said front-to-back upper axis are axially out of line; and said lower gating member, said lower drive pin, and said front-to-back lower axis are axially out of line.

11. The dispensing apparatus of claim 10 wherein said dispensing assembly further comprises:

a reciprocating drive plate with upper and lower drive slots respectively receiving said upper and lower drive pins.

12. The dispensing apparatus of claim 11 wherein said dispensing assembly is further disposable in a single depth mode.

13. The dispensing apparatus of claim 11 wherein said dispensing assembly further includes a mounting portion in between said upper and lower gating members, said upper and lower gating members pivotably mounted to said mounting portion, and said mounting portion includes an upper cutout and a lower cutout for respectively receiving said upper and lower drive pins.

14. The dispensing apparatus of claim 11 wherein said drive plate further includes a motor-driven slot driven by a plate drive pin which is rotatably driven by said motor.

15. A dispensing apparatus including at least one dispensing assembly comprising:

(a) a compartment defined by front, back, right side, and left side walls and adapted to store a plurality of cylindrical articles in column arrangements, (b) a motor-driven upper gating member for normally blocking downward movement of cylindrical articles stored in said compartment and controllable for releasing cylindrical articles for downward movement, said upper gating member extending longitudinally front-to-back and reciprocately moving between right and left, (c) a motor-driven lower gating member for normally blocking downward movement of cylindrical articles which have been released by said upper gating member and for selectively releasing cylindrical articles for downward movement, said lower gating member extending longitudinally front-to-back and reciprocately moving between right and left, (d) a dispensing zone under said lower gating member for receiving cylindrical articles released by said lower gating member, (e) a first removable retaining member attachable at one of said side walls in a retaining position, and wherein said dispensing assembly is operative to dispense one cylindrical article at a time and is disposable in:

I. a first mode with said first removable retaining member removed from its retaining position and dispensing cylindrical articles stored in at least a first column in said compartment, and II. a second mode with said first removable retaining member attached in said retaining position and dispensing cylindrical articles from at least one more column than in said first mode, alternately dispensing cylindrical articles from at least first and second tandem columns of cylindrical articles, said first removable retaining member retaining second column cylindrical articles when a first column cylindrical article is released by said lower gating member, and wherein said upper gating member is movable relative to said lower gating member; and wherein said storage compartment is adapted to store columns of staggered cylindrical articles, each column having a first subcolumn and a second subcolumn, one subcolumn adjacent said right side wall and another subcolumn adjacent said left side wall, and said dispensing assembly further comprises a second removable retaining member attachable at the other of said side walls in a retaining position and functioning identically to said first removable retaining member, said first and second removable retaining members respectively serving to retain first and second subcolumn cylindrical articles of said second column, and wherein said dispensing assembly further comprises a freely swinging antitheft bar having stepped portions on right and left sides to prevent cylindrical articles from being improperly dispensed by being slid in an axial direction.

16. A dispensing apparatus including at least one dispensing assembly comprising:

(a) a compartment defined by front, back, right side, and left side walls and adapted to store a plurality of cylindrical articles in column arrangements, (b) a motor-driven upper gating member for normally blocking downward movement of cylindrical articles stored in said compartment and controllable for releasing cylindrical articles for downward movement, said upper gating member extending longitudinally front-to-back and reciprocately moving between right an left, (c) a motor-driven lower gating member for normally blocking downward movement of cylindrical articles which have been released by said upper gating member and for selectively releasing cylindrical articles for downward movement, said lower gating member extending longitudinally front-to-back and reciprocately moving between right and left, (d) a dispensing zone under said lower gating member for receiving cylindrical articles released by said lower gating member, (e) a first removable retaining member attachable at one of said side walls in a retaining position, and wherein said dispensing assembly is operative to dispense one cylindrical article at a time and is disposable in:

I. a first mode with said first removable retaining member removed from its retaining position and dispensing cylindrical articles stored in at least a first column in said compartment, and II. a second mode with said first removable retaining member attached in said retaining position and dispensing cylindrical articles from at least one more column than in said first mode, alternately dispensing cylindrical articles from at least first and second tandem columns of cylindrical articles, said first removable retaining member retaining second column cylindrical articles when a first column cylindrical article is released by said lower gating member, and wherein said upper gating member is movable relative to said lower gating member; and wherein said storage compartment is adapted to store columns of staggered cylindrical articles, each column having a first subcolumn and a second subcolumn, one subcolumn adjacent said right side wall and another subcolumn adjacent said left side wall, and said dispensing assembly further comprises a second removable retaining member attachable at the other of said side walls in a retaining position and functioning identically to said first removable retaining member, said first and second removable retaining members respectively serving to retain first and second subcolumn cylindrical articles of said second column, and wherein said first mode is a double depth mode and said second mode is a triple depth mode.

17. The dispensing apparatus of claim 16 wherein said dispensing assembly further comprises:

a removable gating piece attachable to said lower gating member in said second mode for preventing a cylindrical article in one of said columns from dropping into said dispensing zone at the same time as the dropping of a cylindrical article in another column.

18. The dispensing aparatus of claim 16 wherein each of said removable retaining members includes an anti-theft stop to prevent cylindrical articles from being improperly dispensed by being slid in an axial direction.

19. The dispensing apparatus of claim 16 wherein said dispensing assembly further comprises:

upper and lower drive pins respectively connected to said upper and lower gating members for causing the pivoting of said upper and lower gating members respectively about a front-to-back upper axis and a front-to-back lower axis, and a motor operably connected to drive said upper gating member and said lower gating member by respectively driving said upper and lower drive pins.

20. The dispensing apparatus of claim 19 wherein said upper gating member, said upper drive pin, and said front-to-back upper axis are axially out of line; and said lower gating member, said lower drive pin, and said front-to-back lower axis are axially out of line.

21. The dispensing appartus of claim 16 wherein said dispensing assembly further comprises right and left ledges projecting out from said respective right and left side walls, each of said ledges supporting cylindrical articles against premature droping into said dispensing zone.

22. The dispensing apparatus of claims 3, 9, or 16 wherein said upper gating member comprises an elongate concave down cylindrically curved part.

23. The dispensing apparatus of claim 3, 9 or 16 wherein said upper gating member is positioned to move without ever lifting any cylindrical articles.

24. A dispensing apparatus including at least one dispensing assembly comprising:

(a) a compartment defined by front, back, right side, and left side walls and adapted to store a plurality of cylindrical articles in column arrangements, (b) a motor-driven upper gating member for normally blocking downward movement of cylindrical articles stored in said compartment and controllable for releasing cylindrical articles for downward movement, said upper gating member extending longitudinally front-to-back and reciprocately moving between right and left, (c) a motor-driven lower gating member for normally blocking downward movement of cylindrical articles which have been released by said upper gating member and for selectively releasing cylindrical articles for downward movement, said lower gating member extending longitudinally front-to-back and reciprocately moving between right and left, (d) a dispensing zone under said lower gating member for receiving cylindrical articles released by said lower gating member, (e) a first removable retaining member attachable at one of said side walls in a retaining position, and wherein said dispensing assembly is operative to dispense one cylindrical article at a time and is disposable in:

I. a first mode with said first removable retaining member removed from its retaining position and dispensing cylindrical articles stored in at least a first column in said compartment, and II. a second mode with said first removable retaining member attached in said retaining position and dispensing cylindrical articles from at least one more column than in said first mode, alternately dispensing cylindrical articles from at least first and second tandem columns of cylindrical articles, said first removable retaining member retaining second column cylindrical articles when a first column cylindrical article is released by said lower gating member, and wherein said upper gating member is movable relative to said lower gating member, and wherein said storage compartment is adapted to store columns of staggered cylindrical articles, each column having a first subcolumn and a second subcolumn, one subcolumn adjacent said right side wall and another subcolumn adjacent said left side wall, and said dispensing assembly further comprises a second removable retaining member attachable at the other of said side walls in a retaining position and functioning identically to said first removable retaining member, said first and second removable retaining members respectively serving to retain first and second subcolumn cylindrical articles of said second column, and wherein each of said removable retaining members, when in its retaining position, comprises a ledge projecting out from one of said side walls.

25. A dispensing apparatus including at least one dispensing assembly comprising:

(a) a compartment defined by front, back, right side, and left side walls and adapted to store a plurality of cylindrical articles in column arrangements, (b) a motor-driven upper gating member for normally blocking downward movement of cylindrical articles stored in said compartment and controllable for releasing cylindrical articles for downward movement, said upper gating member extending longitudinally front-to-back and reciprocately moving between right and left, (c) a motor-driven lower gating member for normally blocking downward movement of cylindrical articles which have been released by said upper gating member and for selectively releasing cylindrical articles for downward movement, said lower gating member extending longitudinally front-to-back and reciprocately moving between right and left, (d) a dispensing zone under said lower gating member for receiving cylindrical articles released by said lower gating member, (e) a first removable retaining member attachable at one of said side walls in a retaining position, and wherein said dispensing assembly is operative to dispense one cylindrical article at a time and is disposable in:

I. a first mode with said first removable retaining member removed from its retaining position and dispensing cylindrical articles stored in at least a first column in said compartment, and II. a second mode with said first removable retaining member attached in said retaining position and dispensing cylindrical articles from at least one more column than in said first mode, alternately dispensing cylindrical articles from at least first and second tandem columns of cylindrical articles, said first removable retaining member retaining second column cylindrical articles when a first column cylindrical article is released by said lower gating member, and wherein said upper gating member is movable relative to said lower gating member, and programmable cam and at least one switch controlled by a cam follower following said programmable cam, said programmable cam setting the mode of said dispensing assembly.

* * * * *